US006568131B1

(12) United States Patent
Milano, Jr.

(10) Patent No.: US 6,568,131 B1
(45) Date of Patent: May 27, 2003

(54) MOTORIZED SHUTTER ASSEMBLY

(75) Inventor: Arthur J. Milano, Jr., Burlington, CT (US)

(73) Assignee: Seitz Corporation, Torrington, CT (US)

( * ) Notice: Subject to any disclaimer, the term of this patent is extended or adjusted under 35 U.S.C. 154(b) by 0 days.

(21) Appl. No.: 10/104,389

(22) Filed: Mar. 20, 2002

(51) Int. Cl.[7] ..... E06B 7/096
(52) U.S. Cl. ..... 49/82.1; 49/25
(58) Field of Search ..... 49/74.1, 82.1, 49/104, 107, 25

(56) References Cited

U.S. PATENT DOCUMENTS

| | | | | | |
|---|---|---|---|---|---|
| 21,732 | A | | 10/1858 | Babcock | |
| 2,675,228 | A | * | 4/1954 | Baird et al. | 49/482.1 |
| 2,806,689 | A | * | 9/1957 | Miller | 49/482.1 |
| 3,068,971 | A | * | 12/1962 | Ringler | 49/482.1 |
| 3,991,518 | A | | 11/1976 | Ishihara | |
| 4,427,048 | A | | 1/1984 | Osaka et al. | |
| 4,860,492 | A | * | 8/1989 | Roy | 49/482.1 |
| 4,934,438 | A | * | 6/1990 | Yuhas et al. | 49/482.1 |
| 5,029,413 | A | | 7/1991 | Jovanovic | |
| 5,379,551 | A | | 1/1995 | Swapp | |
| 5,782,036 | A | * | 7/1998 | Bertieri et al. | 49/25 |
| 6,014,839 | A | | 1/2000 | Ruggles | |
| 6,145,251 | A | | 11/2000 | Ricci | |

* cited by examiner

*Primary Examiner*—Jerry Redman

(57) ABSTRACT

A motorized shutter assembly includes a frame having a pair of parallel spaced frame members, louver slats extending between the frame members and having shafts extending into and pivotably seated in the frame members. A coupling is engaged with the louver slats to produce concurrent pivotal movement of the louver slats in either direction. An adapter on one of the frame members has a drive portion engaged with the end of a louver slat and is rotatable to effect pivotal movement of the slats in either direction. The adapter is engaged with a reversible drive motor assembly to effect rotation of said adapter and the adapter also desirably provides a clutch to protect the drive motor assembly.

13 Claims, 6 Drawing Sheets

MOTORIZED SHUTTER ASSEMBLY

BACKGROUND OF THE INVENTION

The present invention relates to motorized louvered shutters for windows and the like, and to a motorized unit to enable conversion of manually operated louvered shutters.

Interior shades are widely employed, particularly in commercial buildings, to control the sunlight entering into the interior of the buildings, and they are particularly useful in limiting interior heating caused by the sun's rays and the resultant electrical demands for air conditioning. They also serve the function of limiting radiation losses due to convection of air within the interior and into contact with the cold windows over which they are placed.

More recently, large louvered shutters have been proposed for use in commercial buildings. Such shutters have a frame in which a multiplicity of louver slats are pivotally mounted; the louver slats are normally horizontally oriented, although some installations utilize a vertical orientation. Although such shutters may utilize manual cord pulls or other manipulatable elements to effect the pivotal movement for opening or closing, it is desirable to employ a motorized unit to effect that opening and closing.

Some buildings utilize controls which automatically open and close the shades at a predetermined time in an effort to control energy consumption. It would be advantageous to apply this principle to louvered shutters.

It is an object of the present invention to provide a novel motorized louvered shutter which is relatively economical to fabricate and reliable in operation.

It is also an object to provide such a motorized shutter which can be produced by inserting a compact drive assembly into an aperture in the frame for the shutter either as a factory installation or as a field installation on shutters which have been previously installed.

Another object is to provide such a motorized shutter in which there is included means to limit the potential for damage to the louver slats of the shutter and/or the gear drive in the event of manual pivoting of one or more of the slats or of over-energization of the motor.

SUMMARY OF THE INVENTION

It has now been found that the foregoing and related objects may be readily attained in a motorized shutter assembly comprising a frame having a pair of parallel spaced frame members and a multiplicity of louver slats extending between the frame members and having shafts extending into and pivotably seated in the frame members. Coupling means is engaged with the louver slats to produce concurrent pivotal movement of the louver slats in either direction, and an adapter on one of the frame members has a drive portion engaged with the end of one of the louver slats. The adapter is rotatable to effect pivotal movement of the one slat and thereby the multiplicity of slats in either direction. A reversible drive motor assembly is engaged with the adapter to effect its rotation and thereby the slats in either direction. Also included are power supply means for the drive motor assembly, and control means for the power supply means.

Generally, the drive motor assembly includes a multiplicity of intermeshed gears including input and output gears to reduce the speed of rotation from that of the driven input gear and to increase the torque at the output gear. The adapter and the output gear have interfitting coupling elements which desirably include a coupling member engaged with the output gear and having a slot therein seating a rib on the adapter.

Preferably, the adapter includes a clutch to protect the gears of the gear assembly from injury in the event of an obstruction preventing, or manual action causing, rotation of the slats. The clutch is provided by a body member with a base wall and a side wall, a recess therein and a transverse slot seating the end of the one slat. A shaft extends therethrough and a coil spring in the recess extends about the shaft. A washer bears on the outer end of the spring, a clutch plate bears upon the outer surface of the base wall, and interengaging means is provided on the base wall and clutch plate.

The control means includes a switch operable by a sensor and a transmitter for sending a signal to the sensor and the power supply means is a batter. The control means includes a power monitor to terminate power supply to the motor assembly in the event that the slat cannot be further rotated, and the motor gear assembly, power supply means and control means are disposed within a housing disposed in a cavity in the one frame member.

DETAILED DESCRIPTION OF THE ILLUSTRATED EMBODIMENT

Figure 1:
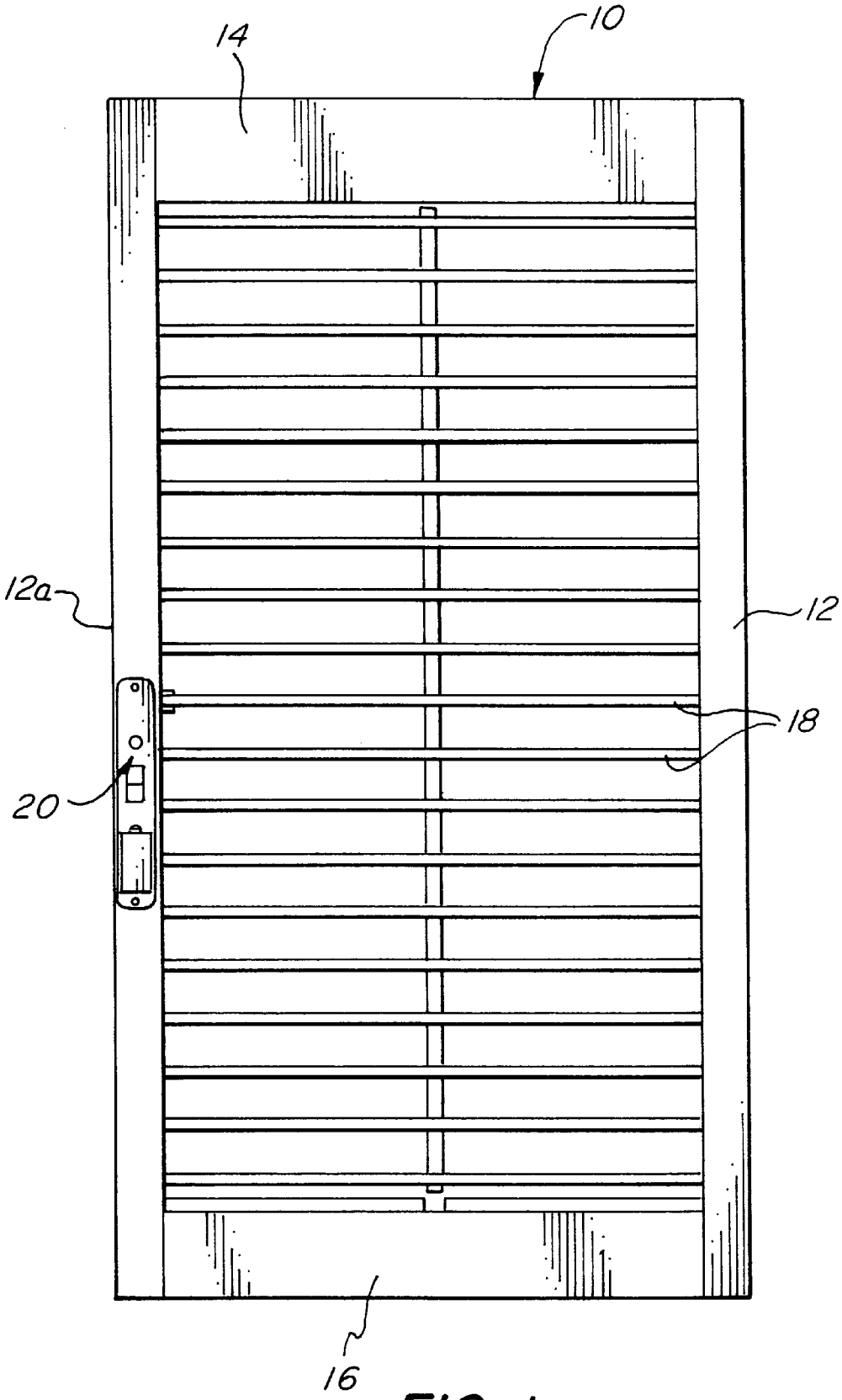
FIG. 1 is an elevational view of the outer face of a shutter incorporating the present invention.

Turning first to FIG. 1 of the attached drawings, a louver-type shutter is generally designated by the numeral 10 and includes a rectangular frame comprised of stiles 12, header 14 and base 16. A multiplicity of slats 18 have their ends pivotally mounted in the stiles 12, and a motion bar 19 (seen in FIG. 3) is connected to all of the slats 18 so that they are pivoted in unison. Also shown is a motorized drive unit generally designated by the numeral 20.

Figure 3:
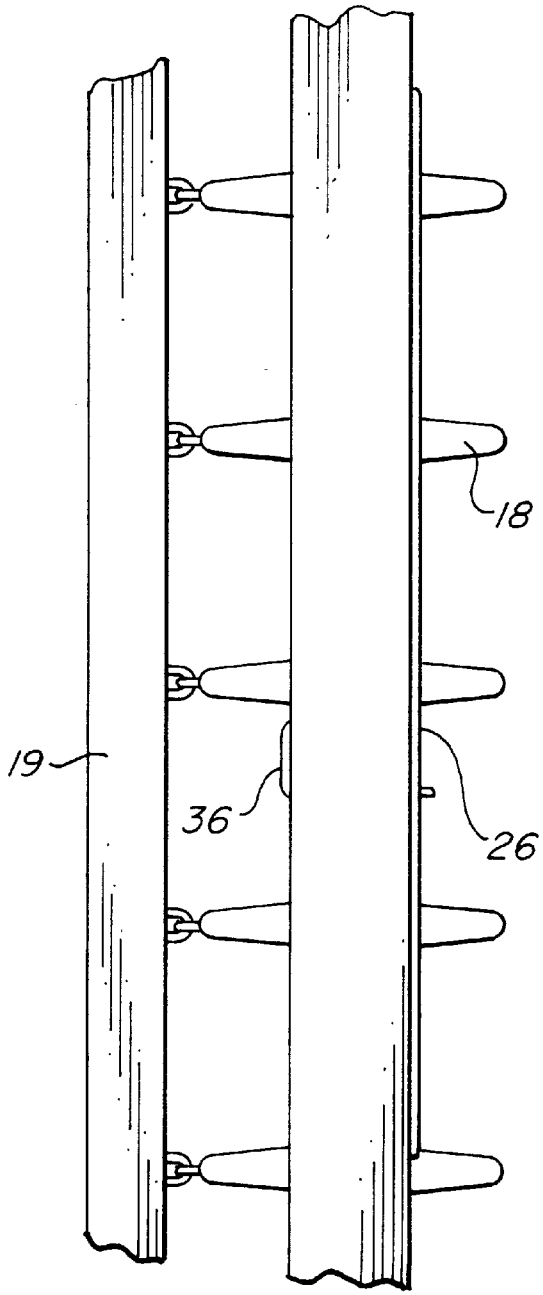
FIG. 3 is an enlarged fragmentary side elevational view of the shutter of FIG. 1.
Figure 2:
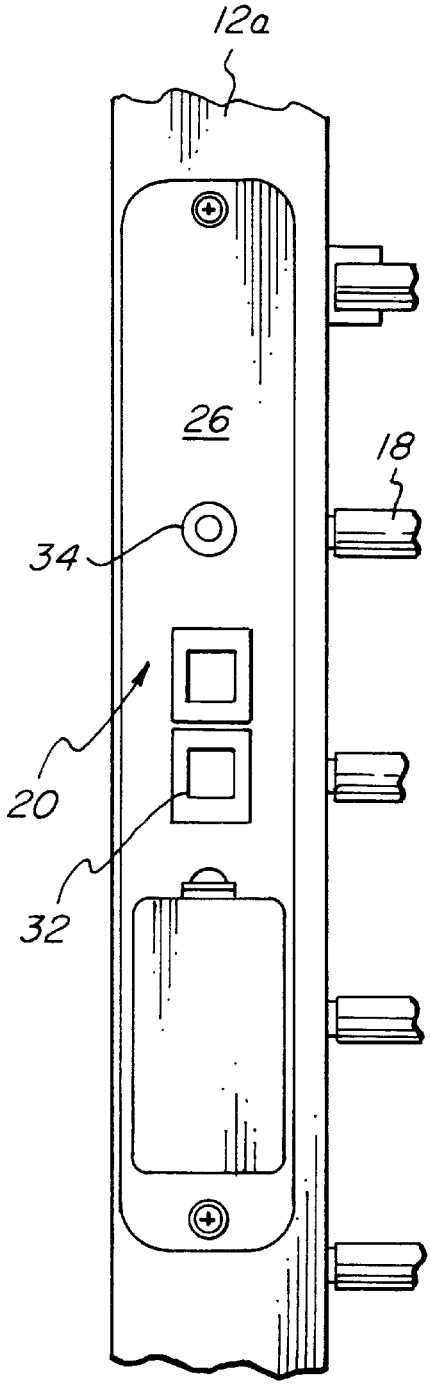
FIG. 2 is an enlarged fragmentary rear view of the shutter and motorized unit of FIG. 1.
Figure 4:
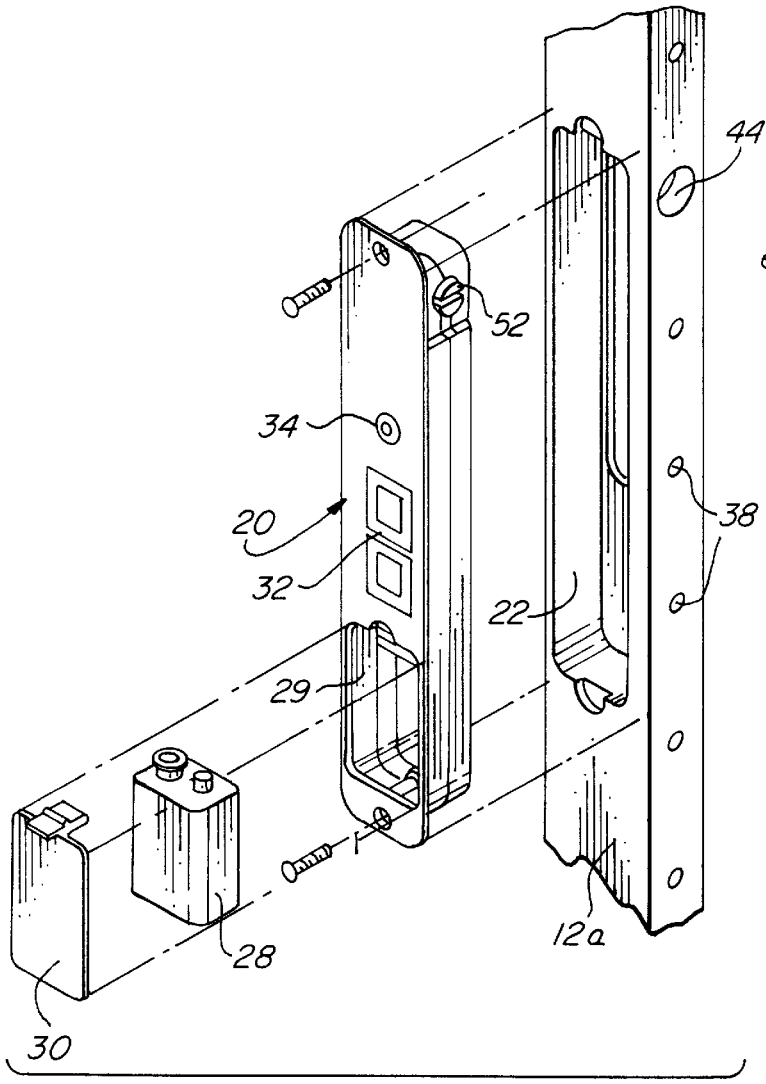
FIG. 4 is a partially exploded view of the motorized unit.

Turning next to FIGS. 2–4, it can be seen that the motorized drive assembly 20 seats in an aperture 22 in the stile 12*a*, and it includes a housing 24 with a face place 26. A battery 28 is seated in a cavity 29 in the housing 24 and its compartment is closed by the cover 30. Input/output jacks 32 and a power receptacle 34 are mounted in the face plate 26. On the opposite face of the housing 24 is an infrared sensor 36.

Figure 5:
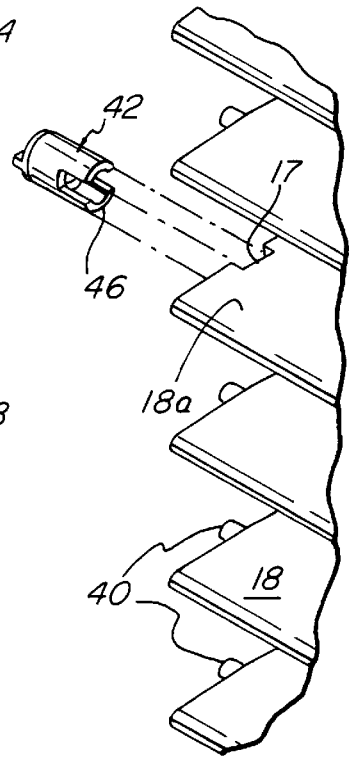
FIG. 5 is a perspective view of the adapter and fragmentarily illustrated slats.
Figure 6:
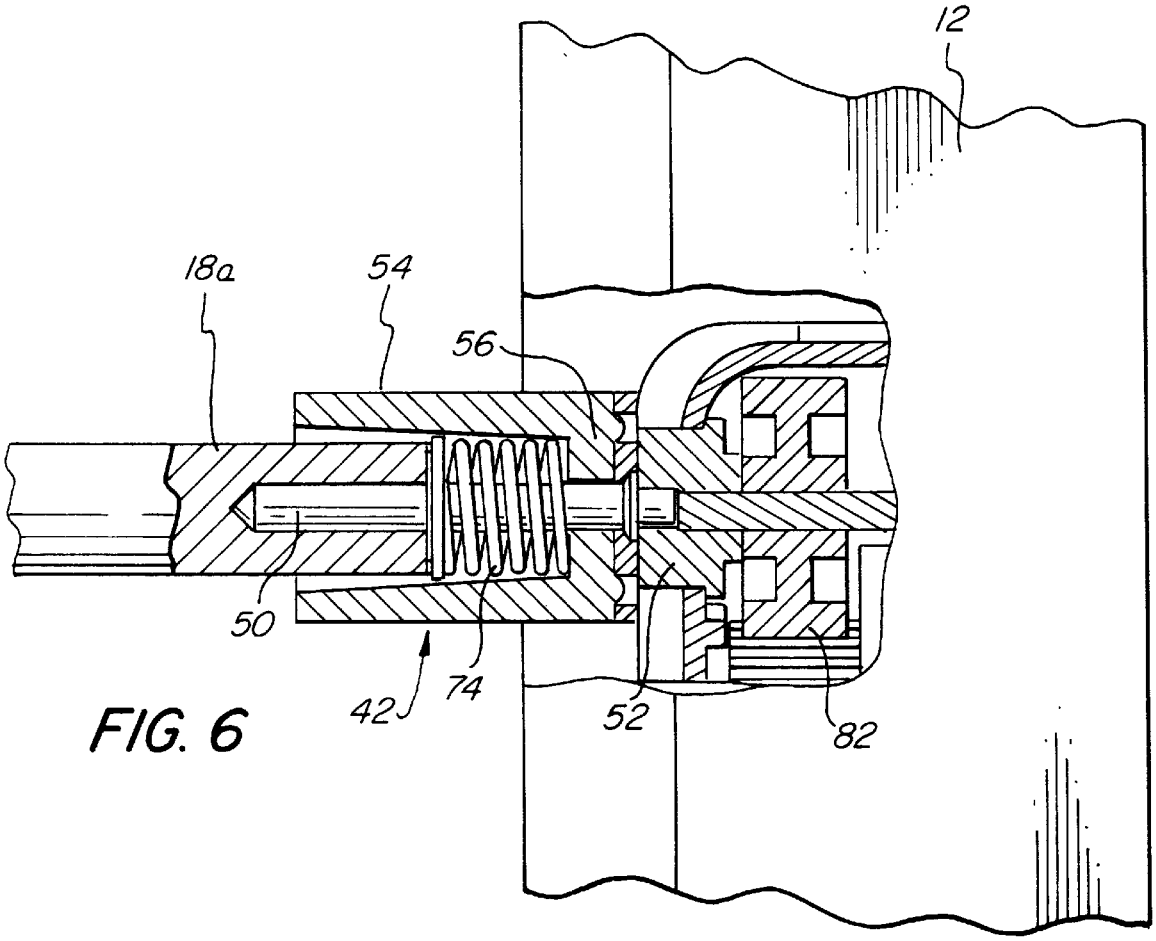
FIG. 6 is an enlarged fragmentary, partially sectional view of the adapter as coupled to the output connector of the motor/gear assembly and to the louver slat.
Figure 7:
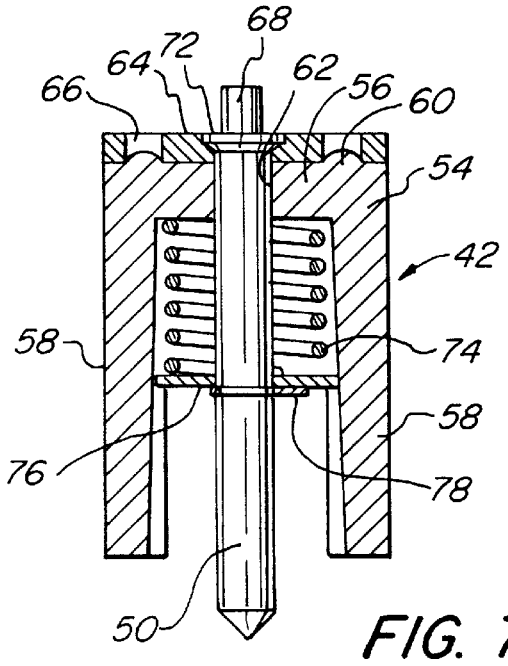
FIG. 7 is a sectional view of the adapter.
Figure 9:
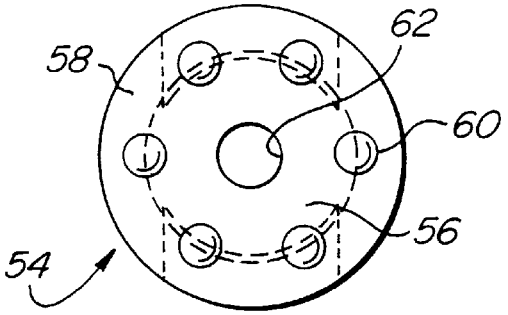
FIG. 9 is a plan view of the base surface of the adapter body.
Figure 11:
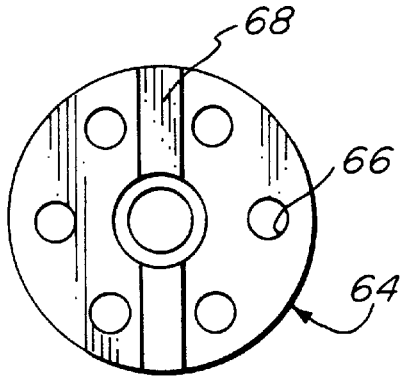
FIG. 11 is a plan view of the outer face of the clutch plate.
Figure 8:
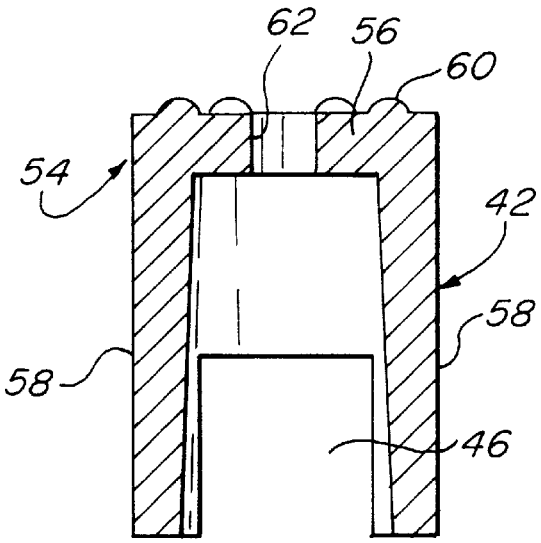
FIG. 8 is a cross sectional view of the adapter body.
Figure 10:
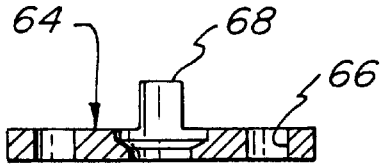
FIG. 10 is a cross elevational view of the clutch plate.
Figure 12:
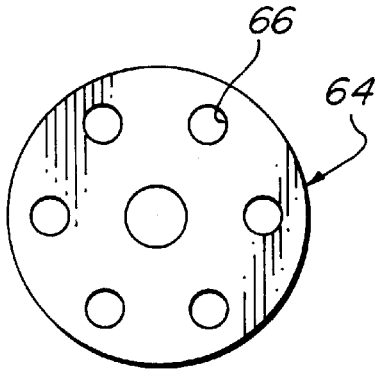
FIG. 12 is a plan view of the inner face of the clutch plate.
Figure 13:
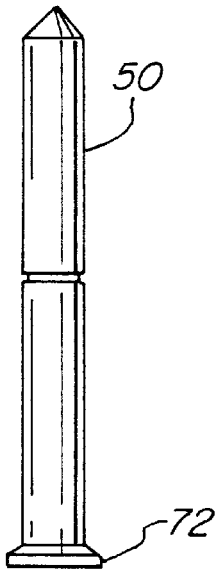
FIG. 13 is a side view of the adapter shaft.

FIGS. 4 and 5 show the apertures 38 in the stile 12 for seating the pivot shafts 40 on the ends of the slats 18. As seen in FIG. 5, the adapter generally designated by the numeral 42 seats in the larger diameter aperture 44 and is connected to the output connector 52 of the motorized drive assembly 20. The adapter 42 has a slot 46 which seats the end of the slat 18*a*, and the slat 18*a* has a notch 17 to seat the body of the adapter 42 and its shaft 50.

As seen in FIGS. 7–13, the adapter 42 includes a shell or body member generally designated by the numeral 54 having a base wall 56 and a pair of spaced arcuate side walls 58 providing the transverse slot 46 therebetween. On the outer surface of the base wall 56 are a series of spaced spheroidal detents 60, and the base wall 56 also has a coaxial aperture 62 through which the shaft 50 extends.

Bearing against the base wall 56 is a clutch plate generally designated by the numeral 64 which has a series of apertures 66 in its inner face cooperating with the detents 60. A rib 68 extends diametrically across its outer surface and seats in a diametrically extending slot in the output connector 52. The end of the shaft 40 has a collar 72 bearing against the outer surface of the clutch plate 64. Seated within the recess of the body member 54 is a coil spring 74 which is held in place by the washer 76 and clip 78.

Figure 14:
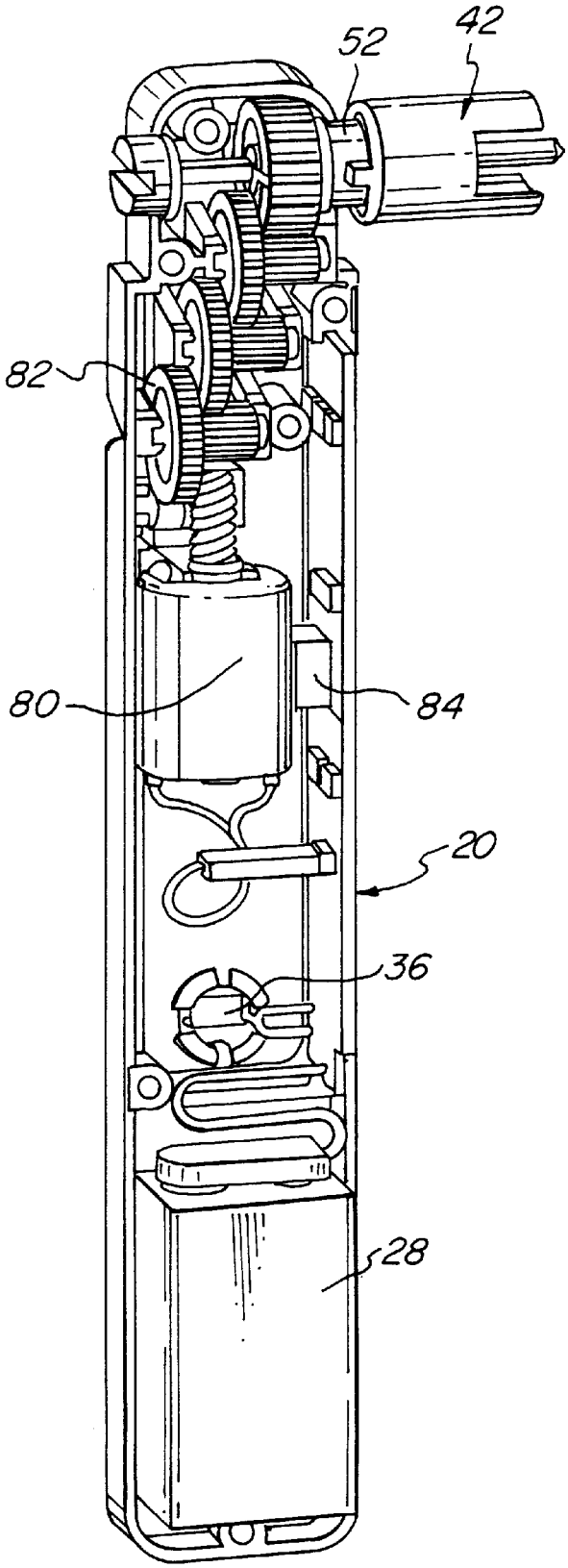
FIG. 14 is a perspective view of the motorized unit with the cover removed.

Turning lastly to FIG. 14, the drive assembly components include a motor 80, a series of intermeshed gears 82 to reduce the speed to 6–10 rpm as delivered by the output connector 52 to the adapter 22. Also shown is a circuit board 84 which controls motor operation.

Depending upon the installation, power may be provided by a battery 28 or by an external power source connected to the receptacle 34. Signals can be received by the assembly through the infrared sensor 36 or through a connection to the input jack 32; and a series of shutters can be interconnected by cables between their respective input and output jacks.

In operation of the illustrated embodiment, a signal is generated and transmitted to the motorized assembly to initiate operation of the electric motor to pivot the louver slats into the desired position to effectively limit light passing through the window or to admit maximum light. This signal can be generated by an infrared transmitter which is manually operated, or by a hard wired switch connected to an input jack and the switch may be on the drive assembly or remotely located. If so desired, a series of shutters can be interconnected by electrical wiring so that a single signal transmission will concurrently operate a number of shutters. Because the louver slats of each shutter are interconnected by a control bar, the pivoting of the louver slat with which the adapter is engaged effects concurrent movement of all louver slats.

In the illustrated embodiment, power to operate the motor is supplied by the battery, but an external power source can also be plugged into the power receptacle.

Included within the motorized assembly is a circuit board which receives the "power on" signal and reverses the direction in which the motor had previously operated to move the louver slats into an open or closed position as the case may be. The circuit board desirably includes control circuitry to limit the time period during which the motor rotates the louver slats and to avoid applying an excess amount of rotational motion which could injure the slat or the drive gears which are utilized to reduce the speed of rotation of the motor.

In a preferred embodiment, the control circuit recognizes that increased power is being called for in an effort to effect further rotation of the slat after the slat reaches the full open or full closed position. This recognition of increased power demand operates to immediately turn off the power to the motor. An alternative arrangement is a timer circuit which limits the length of the time period in which power is supplied to only that required to effect the movement of the louver slats to the open or the closed position.

The control circuit can be programmed to allow movement of the slats into a downward orientation or an upward orientation as well as a horizontal position which represents a full open position.

The assembly of the present invention employs an adapter which provides a unique drive connection between the motorized assembly and the slats. As shown in the attached drawings, the adapter functions as a self-contained clutch which will allow slippage at the time that there is resistance to movement of the louver slat. This resistance will overcome the spring biasing pressure retaining the detents on the adapter body in the apertures in the clutch plate, and the adapter body will remain motionless as the clutch plate rotates during the continuing rotation of the output connector of the gear assembly. This avoids injury to the gear assembly as well as the slats.

Since the unit is essentially self-contained, it may be readily installed on shutters at the factory or in the field, since all that is required is the cutting of the frame to provide the aperture to seat the motorized unit and drilling the lateral opening to seat the adapter. From an aesthetic standpoint, it is preferable to notch the end of the slat which is to be controlled by the adapter from an aesthetic standpoint.

Thus, it can be seen from the foregoing detailed specification and attached drawings that the present invention provides a novel and long-lived motorized louvered shutter which can be readily installed and which provides a neat appearance in a finished installation. Moreover, the preferred assembly provides a self-contained clutch assembly to minimize the potential for damage to the louver slat to which is connected and to the gears in the event of a malfunction or manual movement of a louver slats.

Having thus described the invention, what is claimed is:

1. A motorized shutter assembly comprising:

(a) a frame having a pair of parallel spaced frame members;

(b) a multiplicity of louver slats extending between said frame members and having shafts extending into and pivotably seated in said frame members;

(c) coupling means engaged with said louver slats to produce concurrent pivotal movement of said louver slats in either direction;

(d) an adapter on one of said frame members and having a drive portion engaged with the end of one of said louver slats, said adapter being rotatable to effect pivotal movement of said one of said louver slats and thereby said multiplicity of slats in either direction;

(e) a reversible drive motor assembly engaged with said adapter to effect rotation of said adapter drive portion and thereby said slats in either direction, said drive motor assembly including a multiplicity of intermeshed gears including input and output gears to reduce the speed of rotation from that of the driven input gear and to increase the torque provided by said output gear, said adapter including a clutch to protect the gears of said gear assembly from injury in the event of an obstruction preventing, or manual action causing, rotation of said slats, said adapter also including a body member with a base wall, a side wall, a recess therein, and a transverse slot seating the end of said one of said louver slats, a shaft extending therethrough, a coil spring in said recess extending about said shaft, a washer bearing on the outer end of the spring, a clutch plate bearing upon the outer surface of said base wall, and interengaging means on said base wall and clutch plate;

(f) power supply means for said drive motor assembly; and (g) control means for said power supply means.

2. The motorized shutter assembly in accordance with claim 1 wherein said adapter and said output gear have interfitting coupling elements.

3. The motorized shutter assembly in accordance with claim 2 wherein said coupling elements included a coupling member engaged with said output gear and having a slot therein seating a rib on said adapter.

4. The motorized shutter assembly in accordance with claim 1 wherein said control means includes a switch operable by a sensor and a transmitter for sending a signal to said sensor.

5. The motorized shutter assembly in accordance with claim 1 wherein said power supply means is a battery.

6. The motorized shutter assembly in accordance with claim 1 wherein said control means includes a power monitor to terminate power supply to said motor assembly in the event that said one of said louver slats cannot be further rotated.

7. The motorized shutter assembly in accordance with claim 1 wherein said motor, gear assembly, power supply means and control means are disposed within a housing disposed in a cavity in said one of said frame members.

8. A motorized assembly for mounting in a louvered shutter having a multiplicity of louver slats extending between frame members and having shafts extending into and pivotably seated in the frame members, and coupling means engaged with the louver slats to produce concurrent pivotal movement of the louver slats in either direction, said motorized assembly comprising:

(a) a reversible drive motor unit including a housing adapted to be mounted in an aperture in a frame member and containing a motor, gearing to transfer rotary motion of the shaft of said motor to a coupling member, a battery to supply power to said motor and control means for said motor; and (b) an adapter engageable with said coupling member and adapted to be seated in an aperture in the side of the frame member, said adapter having a drive portion engageable with the end of one of the louver slats and being rotatable to effect pivotal movement of said one of said louver slats and thereby the multiplicity of slats in either direction, said adapter including a clutch to protect the reversible drive motor unit from injury in the event of an obstruction preventing, or manual action causing, rotation of the slats, said adapter also including a body member with a base wall and spaced side walls providing a recess therebetween and defining a transverse slot to seat the end of said one of the lower slats, a shaft extending therethrough, a coil spring in said recess extending about said shaft, a washer bearing on the outer end of the spring, a clutch plate bearing upon the outer surface of said base wall, and interengaging means on said base wall and clutch plate releasable upon a rotational force overcoming the bearing force of said spring.

9. The motorized assembly in accordance with claim 8 in which said drive motor unit includes a multiplicity of intermeshed gears including input and output gears to reduce the speed of rotation from that of the driven input gear and to increase the torque provided by said output gear to said coupling member.

10. The motorized assembly in accordance with claim 9 wherein said adapter and said coupling member have interfitting coupling elements.

11. The motorized assembly in accordance with claim 10 wherein said coupling member has a slot therein seating a rib on said adapter.

12. The motorized assembly in accordance with claim 8 wherein said control means includes a switch operable by a sensor and a transmitter for sending a signal to said sensor.

13. The motorized assembly in accordance with claim 8 wherein said control means includes a power monitor to terminate power supply to said motor upon sensing increased power demand by said motor in the event that said one of said louver slats cannot be further rotated.

* * * * *